US010995388B2

(12) United States Patent
Kuroiwa et al.

(10) Patent No.: US 10,995,388 B2
(45) Date of Patent: May 4, 2021

(54) METHOD FOR MANUFACTURING SINTERED ORE

(71) Applicant: JFE STEEL CORPORATION, Chiyoda-ku Tokyo (JP)

(72) Inventors: Masato Kuroiwa, Tokyo (JP); Shunsuke Nonaka, Tokyo (JP); Yukimasa Horikawa, Tokyo (JP); Shunsuke Oura, Tokyo (JP); Tetsuya Jinno, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 16/490,240

(22) PCT Filed: Apr. 20, 2018

(86) PCT No.: PCT/JP2018/016324
§ 371 (c)(1),
(2) Date: Aug. 30, 2019

(87) PCT Pub. No.: WO2018/198980
PCT Pub. Date: Nov. 1, 2018

(65) Prior Publication Data

US 2020/0040427 A1 Feb. 6, 2020

(30) Foreign Application Priority Data

Apr. 27, 2017 (JP) ..... JP2017-088115

(51) Int. Cl.
*C22B 1/16* (2006.01)

(52) U.S. Cl.
CPC ..... *C22B 1/16* (2013.01)

(58) Field of Classification Search
CPC ..... C22B 1/16; C21C 5/32
See application file for complete search history.

(56) References Cited

U.S. PATENT DOCUMENTS 7,074,034 B2 * 7/2006 Hoke, Jr. ..... F23C 7/02 431/10
2015/0300631 A1 * 10/2015 Iwami ..... F27B 21/06 431/174

FOREIGN PATENT DOCUMENTS

EP 2322675 A1 5/2011
EP 3088825 A1 11/2016
(Continued)

OTHER PUBLICATIONS

Feb. 22, 2019, Office Action issued by the Taiwan Intellectual Property Office in the corresponding Taiwanese Patent Application No. 107114286 with English language Concise Statement of Relevance.

(Continued)

*Primary Examiner* — Anthony J Zimmer
*Assistant Examiner* — Jacob James Gusewelle
(74) *Attorney, Agent, or Firm* — Kenja IP Law PC

(57) ABSTRACT

Uneven sintering is prevented in a sintering machine, and thus sintered ore having high strength and a high lump yield rate is manufactured. A method for manufacturing sintered ore comprising: charging sintering raw material comprising fine ore and carbon material on a circulatively moving pallet to form a raw material layer; igniting the carbon material on a surface of the raw material layer and sucking air from above the raw material layer down to below the palette so that the air is introduced into the raw material layer; and combusting the carbon material in the raw material layer to thereby manufacture sintered ore, wherein fuel gas is discharged from a nozzle at a flow speed of 40 m/s or more, the discharged fuel gas is combusted to generate combustion gas, and the combustion gas is used for igniting the carbon material.

8 Claims, 10 Drawing Sheets

(56) References Cited

FOREIGN PATENT DOCUMENTS

| | | | |
|---|---|---|---|
| JP | S6117893 | A | 1/1986 |
| JP | 2010156036 | A | 7/2010 |
| JP | 2013194991 | A | 9/2013 |
| JP | 2014201809 | A | 10/2014 |
| JP | 2014202372 | A | 10/2014 |
| JP | 2016191533 | A | 11/2016 |
| KR | 1020110042353 | A | 4/2011 |
| TW | 201712275 | A | 4/2017 |

OTHER PUBLICATIONS

Jul. 24, 2018, International Search Report issued in the International Patent Application No. PCT/JP2018/016324.

Mar. 9, 2020, the Extended European Search Report issued by the European Patent Office in the corresponding European Patent Application No. 18790529.4.

Dec. 8, 2020, Office Action issued by the China National Intellectual Property Administration in the corresponding Chinese Patent Application No. 201880027216.3 with English language search report.

Jan. 5, 2021, Office Action issued by the Korean Intellectual Property Office in the corresponding Korean Patent Application No. 10-2019-7032147 with English language concise statement of relevance.

* cited by examiner

METHOD FOR MANUFACTURING SINTERED ORE

TECHNICAL FIELD

This disclosure relates to a method for manufacturing sintered ore, and in particular relates to a method for manufacturing sintered ore which can manufacture sintered ore having high strength for blast furnace raw material.

BACKGROUND

For manufacturing sintered ore, a downward suction-type Dwight Lloyd sintering machine is widely used. In the downward suction-type Dwight Lloyd sintering machine, raw material comprising fine ore and carbon material such as coke breeze which functions as fuel are mixed and charged on a palette to form a raw material layer. Subsequently, the coke breeze on a surface of the raw material layer is ignited using an ignition furnace installed above the raw material layer and air above the raw material layer is sucked downward by negative pressure of a wind box installed below the palette. As the result, in the raw material layer, combustion of the coke breeze is gradually shifted downward in the layer to proceed sintering of the raw material, forming a sinter cake. The obtained sinter cake is crushed into lumps having a suitable particle size and subjected to particle size adjustment. Then, the lumps are charged into a blast furnace, where the sintered ore is reduced into pig iron.

As a burner used in the ignition furnace of the sintering machine, typically used are a slit burner in which fuel gas and air for combustion are pre-mixed and blown from a slit-shaped nozzle to combust the fuel gas and a line burner which has many nozzles for fuel gas and air for combustion disposed in the width direction of an ignition furnace (a direction intersecting a shift direction of a raw material layer). In recent years, a burner which has a structure as described in JP 2013-194991 A (PTL 1) is proposed.

CITATION LIST

Patent Literature

PTL 1: JP 2013-194991 A

SUMMARY

Technical Problem

In operation of a blast furnace, it is important to use sintered ore having high strength. When sintered ore having low strength is charged into a blast furnace, powder is generated from the sintered ore and deteriorates air permeability of the blast furnace. Thus, sintered ore to be charged into a blast furnace is required to have high strength. Further, sintered ore having high strength is preferable because such sintered ore is hardly powdered on processes of crush, sieve classification, and handling, and improves the yield rate of lump-like sintered ore charged into a blast furnace. Therefore, there is demand for a method for manufacturing sintered ore having higher strength.

It could thus be helpful to provide a method for manufacturing sintered ore which can manufacture sintered ore having high strength for blast furnace raw material.

Solution to Problem

The inventors thought that for manufacturing sintered ore having high strength, it is necessary to reduce uneven sintering in a raw material layer. With uneven sintering, the strength of sintered ore which has been insufficiently sintered becomes insufficient, easily generating powder. Further, the inventors thought that for reducing uneven sintering in a raw material layer, it is firstly important to uniformly ignite an upper layer of a raw material layer. Then, the inventors made intensive studies as to a method for producing uniform ignition.

As the result, the inventors found that sintered ore having a high lump yield rate and high strength can be manufactured by, in an ignition furnace, increasing the flow speed of gas combusted to ignite a raw material layer compared to conventional one to ignite a raw material layer with high-speed flame, thereby reducing uneven sintering of the raw material layer.

However, as a result of examination, the inventors found that a burner used in a conventional ignition furnace cannot produce fuel gas having a sufficiently high discharge speed, and thus reduction of uneven sintering is limited.

For example, FIG. 10 is a schematic diagram illustrating an example of a premixing combustion burner which is used in a conventional ignition furnace. In a premixing combustion burner 100, flammable fuel gas 101 and air 102 are mixed in advance in the inside of the premixing combustion burner 100 into mixed gas, and the mixed gas is discharged from the premixing combustion burner 100 and combusted to form flame 103.

However, when the flow speed of fuel gas and air is simply increased to increase the discharge speed, flame becomes unstable. When the flow speed is further increased, the balance is lost between the combustion speed and the gas flow speed, causing flame to be blown away to the downstream and quenched, which is called blowoff. Therefore, a conventional burner could not achieve highly increased discharge speed.

Further, as a method for stabilizing flame and preventing blowoff, PTL 1 proposes a method which uses a burner comprising a main burner and a pilot flame burner which assists combustion in the main burner. PTL 1 discloses that blowoff is prevented to thereby improve ignitability and decrease fuel consumption rate, but PTL 1 does not consider increasing gas flow speed to thereby increase the strength of sintered ore, and also has a limit in increasing gas flow speed.

The present disclosure is based on the findings described above and has the following primary features.

1. A method for manufacturing sintered ore comprising:

charging sintering raw material comprising fine ore and carbon material on a circulatively moving pallet to form a raw material layer;

igniting the carbon material on a surface of the raw material layer and sucking air from above the raw material layer down to below the palette so that the air is introduced into the raw material layer; and combusting the carbon material in the raw material layer to thereby manufacture sintered ore, wherein fuel gas is discharged from a nozzle at a flow speed of 40 m/s or more, the discharged fuel gas is combusted to generate combustion gas, and the combustion gas is used for the igniting the carbon material.

2. The method for manufacturing sintered ore according to 1., wherein the combustion gas is generated using a burner comprising:

a main burner part having a fuel gas nozzle configured to discharge the fuel gas and an air nozzle configured to discharge air for combustion; and a sub burner part positioned further outward than the main burner part and configured to combust the fuel gas discharged from the main burner part.

Advantageous Effect

According to this disclosure, it is possible to ignite a sintering layer with combusting gas having high discharge speed to thereby reduce uneven sintering of sintered ore, and thus manufacture sintered ore having high strength and a high lump yield rate.

DETAILED DESCRIPTION

Figure 1:
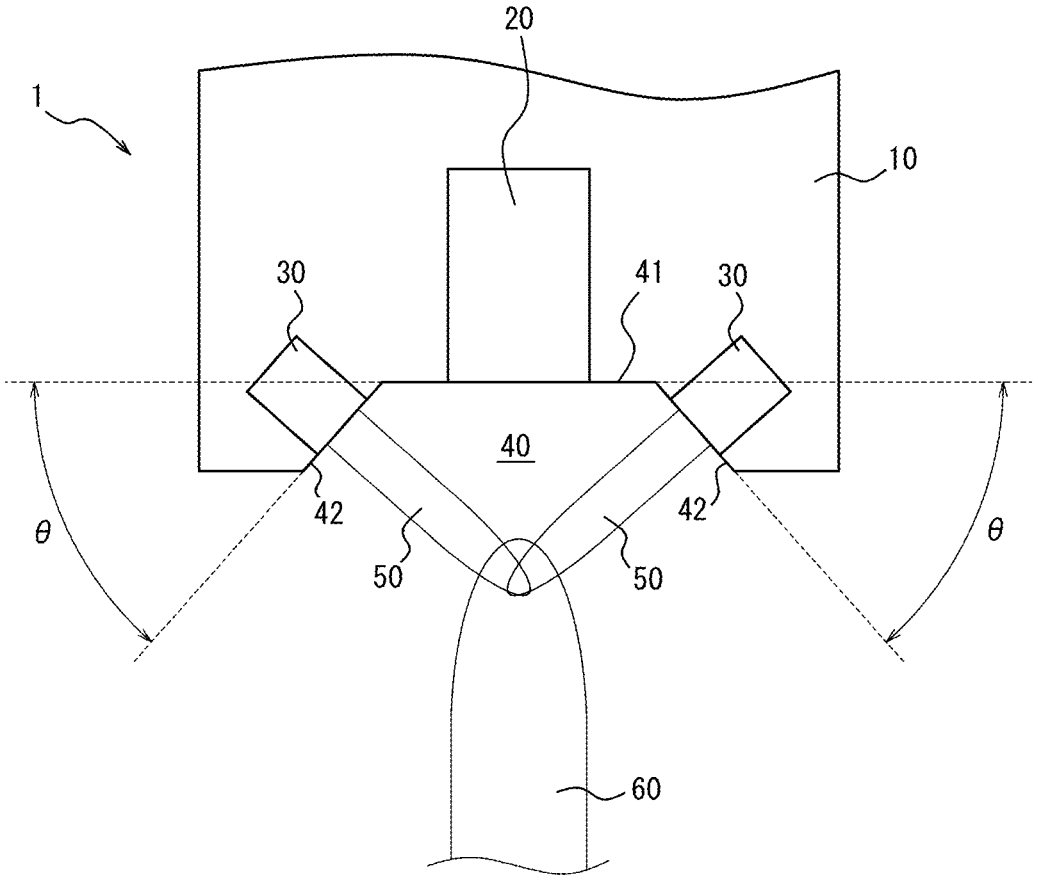
FIG. 1 is a schematic diagram illustrating the structure of a burner in one embodiment.

Next, detailed description is given below. The following provides a description of preferred embodiments and the present disclosure is by no means limited to the description.

In a method for manufacturing sintered ore in one embodiment, sintering raw material comprising fine ore and carbon material is charged on a circulatively moving pallet to form a raw material layer, the carbon material on a surface of the raw material layer is ignited and air is sucked from above the raw material layer by a wind box installed below the palette so that the air is introduced into the raw material layer, and the carbon material is combusted in the raw material layer to manufacture sintered ore.

To perform the manufacturing method, any sintering machine comprising a palette, ignition means (ignition furnace), and mechanism for sucking air downwards from above a raw material layer can be used. That is, a common downward suction-type Dwight Lloyd sintering machine can be used. Further, a gas fuel feeder may be installed on the downstream side of an ignition furnace to feed gas fuel above a raw material layer.

In this disclosure, the fuel gas is discharged from a nozzle at a flow speed of 40 m/s or more, the discharged fuel gas is ignited to generate combustion gas, and the combustion gas is used to ignite the carbon material. The amount of heat transfer Q from flame to a surface of an object to be heated is proportional to the heat transfer coefficient $\alpha$ and the heat transfer coefficient $\alpha$ is larger as the flame speed $V_0$ is increased. In this disclosure, fuel gas is discharged at a high speed of 40 m/s or more and the fuel gas is ignited to thereby generate combustion gas (flame) having a high speed. By hitting the combustion gas having a high speed against a surface of a raw material layer which is an object to be heated, heat can be provided to the raw material layer with extremely high efficiency. According to this disclosure, it is possible to uniformly heat a surface of a raw material layer and uniformly ignite carbon material comprised in the raw material layer, thus manufacturing sintered ore having high strength and a high lump yield rate.

The carbon material can be ignited using any device which discharges fuel gas at a flow speed satisfying the aforementioned conditions and ignites the fuel gas to generate combustion gas.

In one embodiment, the combustion gas can be generated using a burner comprising: a main burner part having a fuel gas nozzle configured to discharge fuel gas and an air nozzle configured to discharge air for combustion; and a sub burner part positioned further outward than the main burner part and configured to combust the fuel gas discharged from the main burner part. The following describes a case of using the burner.

The main burner part comprises a fuel gas nozzle configured to discharge fuel gas and an air nozzle configured to discharge air for combustion. Fuel gas and air which are discharged from the main burner part are combusted with each other to thereby form flame for heating an object to be heated. The sub burner part has a function of igniting fuel gas discharged from the main burner part.

It is important that the sub burner part is positioned further outward than the main burner part. Such a positional relationship enables stably held flame when a discharge speed is high, compared with other positional relationships.

The aforementioned positional relationship enables stably held flame when a discharge speed is high, which is assumed to be because of the following reasons. Specifically, as proposed in PTL 1, when the fuel gas and the air for combustion are disposed so as to sandwich the pilot flame burner, and a discharge direction of fuel gas is set so as to hit against a discharge direction of air for combustion, a vortex occurs, increasing kinetic energy loss due to flow turbulence. Thus a high flow speed cannot be maintained. On the other hand, our technique can prevent flow turbulence of main fuel gas and air for combustion by positioning the sub burner part further outward than the main burner part in the burner, thus maintaining a high flow speed. Further, by making discharge directions of fuel gas and air for combustion which are discharged from the main burner part parallel to one another, flow turbulence can be further prevented, thus maintaining a high flow speed.

In addition, when the fuel gas nozzle is in a center part and the pilot flame burners are disposed on the outside of the center part and the air for combustion nozzles are disposed on the further outside of the pilot flame burners, fuel gas is necessary to be discharged toward the pilot flame on the both sides, thus requiring to set fuel gas nozzles on the both sides, increasing the number of the nozzles. Then, when a discharge speed is intended to be increased, the diameter of each nozzle becomes small to thereby significantly decrease the gas speed after discharge, which makes it impossible to maintain a high flow speed after discharge. On the other hand, our technique does not need to divide fuel gas to the both sides, and thus a high flow speed can be maintained.

[Fuel Gas]

The fuel gas is not limited and any flammable gas can be used as the fuel gas. As the fuel gas, for example, natural gas and LPG are typically available. Process gas produced as a by-product in steelworks can be also used as the fuel gas. As the process gas, in particular, M gas in which coke oven gas and blast furnace gas is mixed is preferably used.

Next, a more detailed description is given below based on drawings.

FIG. 1, which is a schematic diagram of a burner 1 in one embodiment, illustrates a cross sectional structure of the burner 1. The burner 1 comprises a burner body 10, and a main burner part 20 and a sub burner part 30 which are provided in the burner body 10. The burner 1 has at its end (the side on which flame is formed) a recessed part 40, and the recessed part 40 has a bottom part 41 and a tapered part 42, the tapered part gradually widening from the bottom part 41 to the end of the burner 1.

Figure 2:
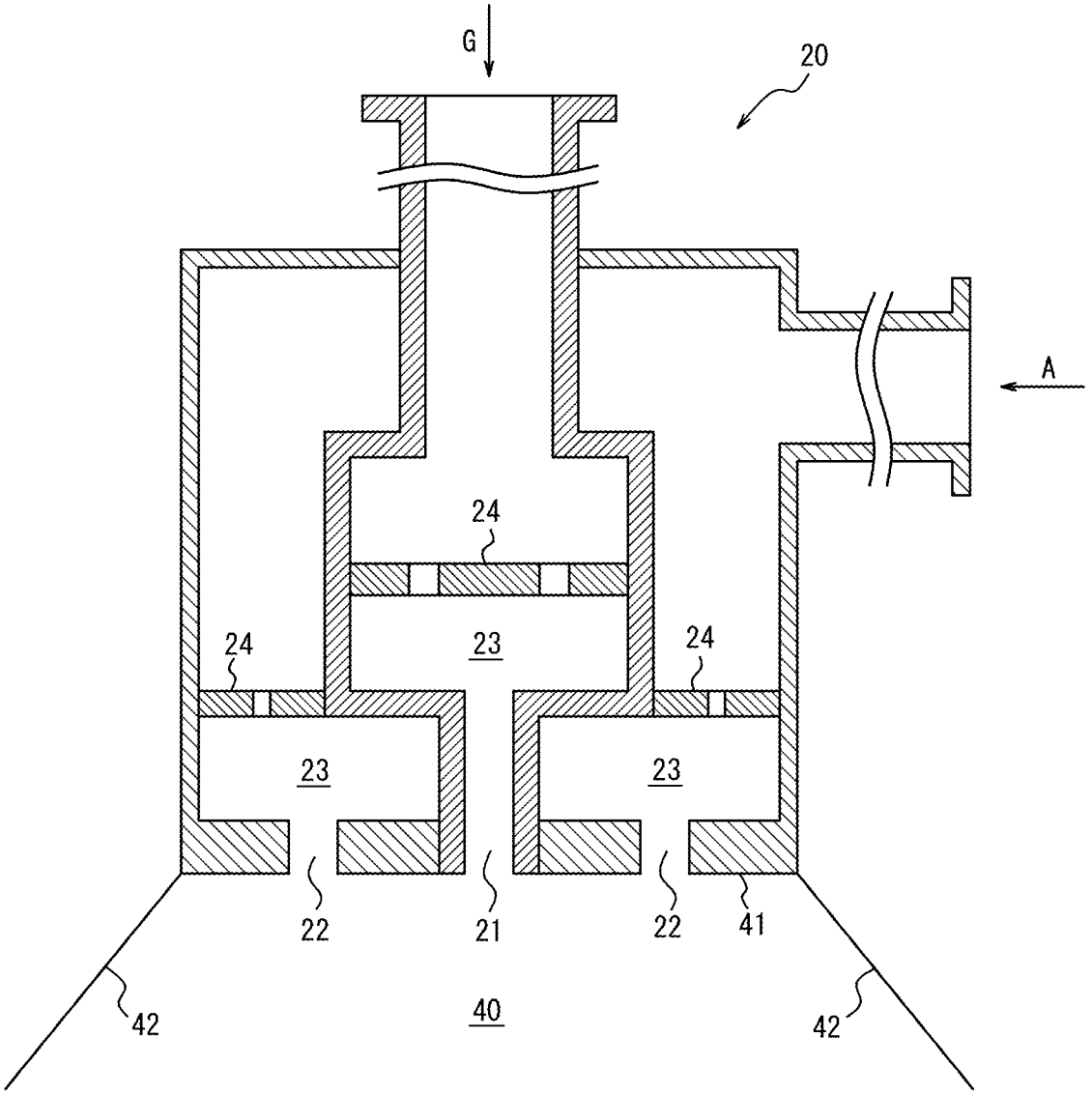
FIG. 2 is a schematic diagram illustrating the structure of a main burner part in one embodiment.

FIG. 2 is a schematic diagram illustrating the structure of a main burner part in one embodiment. The main burner 20 comprises a fuel gas nozzle 21 which discharges fuel gas and an air nozzle 22 which discharges air for combustion. Two air nozzles 22 are provided symmetrically so as to sandwich the fuel gas nozzle 21.

The example illustrated in FIG. 2 illustrates a cross section of one burner, but a plurality of burners is preferably disposed in a perpendicular direction to the paper surface so as to be a line burner. At that time, fuel gas nozzles, air for combustion nozzles, and discharge openings of fuel gas for sub burner flame may not necessarily be located on the same cross section. In the line burner, burners are desirably disposed so that 20 or more fuel gas nozzles of the burners may have as equal intervals as possible per meter in length of the line burner. As the number of fuel gas nozzles disposed per unit length of the line burner is increased, uniform heating is easily performed. However, when too many fuel gas nozzles are disposed, each nozzle diameter becomes too small. Thus, 20 to 150 fuel gas nozzles are preferably disposed per meter in length of the line burner. 30 to 60 fuel gas nozzles are more preferably disposed per meter in length of the line burner. Further, discharge openings of fuel gas of the line burner are preferably disposed 300 mm to 900 mm above from an upper surface of a raw material layer.

The fuel gas is supplied as illustrated by an arrow mark G, and discharged from the fuel gas nozzle 21. The air for combustion is supplied as illustrated by an arrow mark A, and discharged from the air nozzle 22. The fuel gas is not ignited at the discharge, but as illustrated in FIG. 1, it is ignited by sub burner flame 50 formed by the sub burner part 30 to thereby form flame 60. Generally, flame is combustion reaction part where light and heat are generated. In this disclosure, combustion gas includes both flame and gas generated by combustion. The raw material layer comprising carbon material can be ignited by heat of flame and by high-temperature gas generated by combustion, the gas having no flame.

The shapes of the fuel gas nozzle 21 and the air nozzle 22 are not limited and they have any shape. As illustrated in FIG. 2, however, the nozzles preferably have a straight tube structure, which has no cone-like structure on its end. A nozzle having a straight tube structure has little energy loss due to gas vortex and the like, compared with, for example, a nozzle which forms revolving flow, and thus a decrease in the gas speed due to attenuation after discharge is reduced. Therefore, the discharge speed can be further increased to make the heat transfer coefficient larger on a surface to be heated, improving the heating efficiency.

The diameters of the fuel gas nozzle 21 and the air nozzle 22 are desirably determined so that the nozzle discharge speed in a flow rate range in ordinary use may be 50 m/s to 80 m/s to increase the heating efficiency of the burner. The gas flow speed at maximum combustion is desirably 150 m/s or less. Hereinafter, the diameters of the fuel gas nozzle and the air nozzle are simply referred to as "nozzle diameter".

Further, when the nozzle diameter is 3 mm or more, the decrease in the speed of gas after the gas has been discharged from the nozzle can be further prevented. Therefore, the nozzle diameter is preferably 3 mm or more and more preferably 5 mm or more. On the other hand, when the nozzle diameter is 30 mm or less, the increase in the flow rate of fuel gas by discharging gas at a high speed can be prevented, reducing the heat load on the burner. Accordingly, the nozzle diameter is preferably 30 mm or less.

The interval (nozzle pitch) $L_1$ between the fuel gas nozzle and the air nozzle preferably satisfies $2\ d_{NG} \leq L_1 \leq 15\ d_{NA}$, where $d_{NG}$ is a diameter of the fuel gas nozzle 21 and $d_{NA}$ is a diameter of the air nozzle 22. When burners are disposed to make a line burner, the interval (nozzle pitch) $L_2$ between the fuel gas nozzles of the burners preferably satisfies $2\ d_{NG} \leq L_2 \leq 15\ d_{NA}$. When the conditions are satisfied, the combustion stability can be ensured and the decrease in the gas speed can be prevented.

The main burner part 20 comprises pressure equalizing chambers 23 on the upstream side of each of the fuel gas nozzle 21 and the air nozzles 22, and comprises, on the opposite side (upstream side) of the nozzles of the pressure equalizing chambers 23, perforated plates 24 having an opening through which fuel gas or air passes. With such a pressure equalizing chamber 23, gas can be discharged more uniformly, thus further stabilizing flame and further increasing the discharge speed. The pressure equalizing chamber 23 may be provided only on the upstream side of either the fuel gas nozzle 21 or the air nozzles 22, but as illustrated in FIG. 2, the pressure equalizing chamber is preferably provided on the upstream side of both the fuel gas nozzle 21 and the air nozzles 22.

Figure 3:
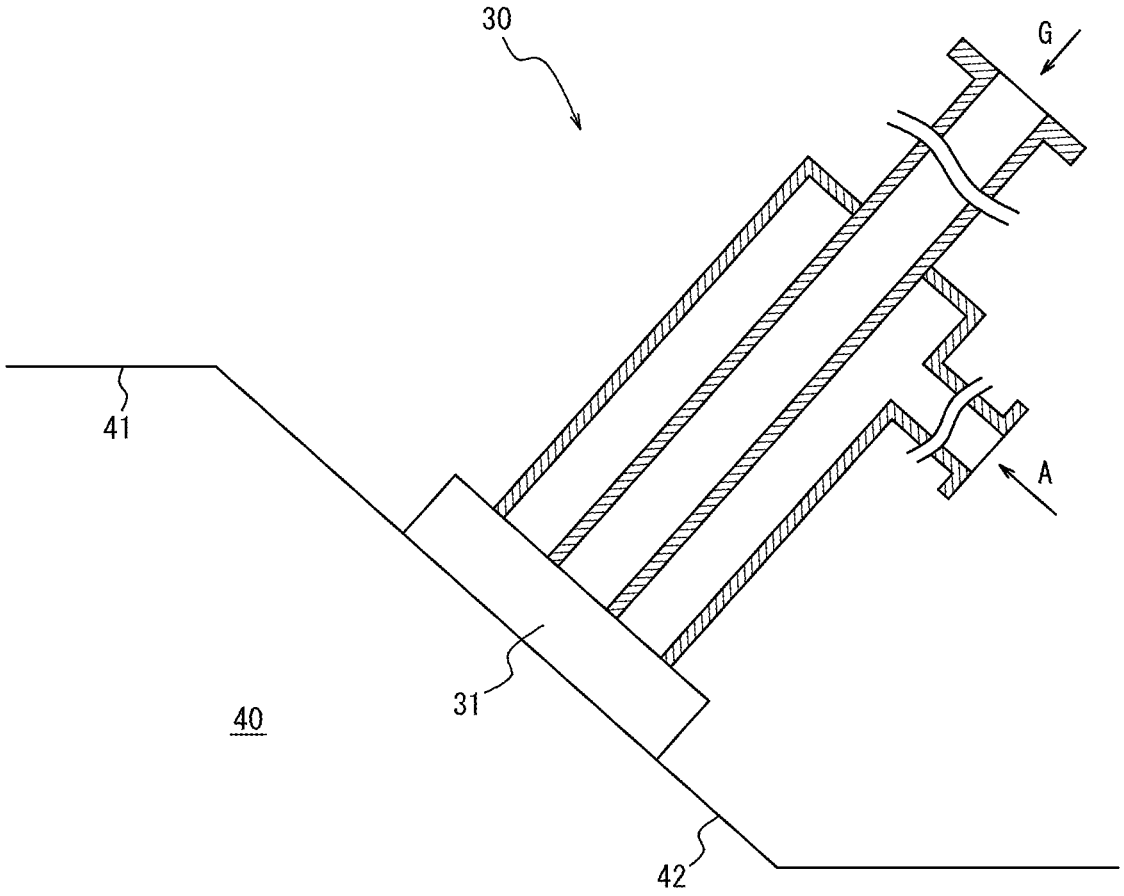
FIG. 3 is a schematic diagram illustrating the structure of a sub burner part in one embodiment.

FIG. 3 is a schematic diagram illustrating the structure of a sub burner part 30 in one embodiment. In this example, the sub burner part 30 includes a surface combustion burner. The surface combustion burner has a porous plate 31 at its end and the porous plate 31 is supplied with fuel gas and air for sub burner flame as illustrated by arrow marks G and A, respectively. In the burner, fuel gas and air are discharged from the main burner part 20 at a high speed, and thus a flow accompanied with the airflow is formed near the end of the burner 1, in particular, in the inside of the recessed part 40. For example, when the flow speed of gas discharged from the main burner part is 50 m/s, the flow speed of the accompanied flow is as high as 20 m/s to 30 m/s. Thus, sub burner flame 50 formed by the sub burner part 30 may be unstable. However, the surface combustion burner has an ignition point in the surface or the inside of the porous plate. Therefore, the sub burner flame can be stably held, not being affected by the accompanied flow.

As the porous plate 31, any plate member made up of a porous body can be used. The porous body can be made up of materials such as metal, alloy, and ceramic. As the porous plate 31, for example, a metal mesh (laminate of metal fibers) can be used. The surface of the porous plate 31 is preferably disposed on the same plane as that of the tapered part 42.

As illustrated in FIG. 1, fuel gas and air discharged from the main burner part 20 are ignited by the sub burner flame 50. Therefore, to ensure the ignition, the main burner part 20 and the sub burner part 30 are preferably disposed so that the discharge axis (discharge direction) of the main burner part 20 and the discharge axis (discharge direction) of the sub burner part 30 may be crossed with each other in their extension lines. Specifically, the bottom part 41 and the tapered part 42 which form the recessed part 40 preferably make an angle θ of 20° or more. When θ is less than 20°, flame of the sub burner part is less likely to reach a gas flow discharged from the main burner part, thus tending to cause flame off. θ is preferably 30° or more. On the other hand, θ may have any upper limit, but typically, θ is preferably 80° or less and more preferably 60° or less.

The distance between the main burner part and the sub burner part is determined so that flame (sub burner flame 50) of the sub burner part can reach the discharged flow from the main burner part. When the effective length of flame of the sub burner part is F, the distance of the flame of the sub burner part reaching in the direction parallel to the bottom part 41 is F·sin θ. Thus, the main burner part and the sub burner part are disposed so that the distance between the edge position of the main burner and the center position of the sub burner part may be F·sin θ or less in the direction parallel to the bottom part 41. Specifically, when the effective length of flame of the sub burner part is 100 mm, the width of the main burner (distance between the outermost nozzles of the main burner part) is 50 mm, and θ=30°, the distance between the center of the main burner part and the center of the sub burner part is 75 mm or less. Considering the preferred range of θ, the distance between the center of the main burner part and the center of the sub burner part is preferably 60 mm to 110 mm. The effective length of flame can be determined, based on the measurement result of a flame temperature, as the length of a region having gas ignition temperature or more from the combustion surface or the tapered surface.

Figure 4:
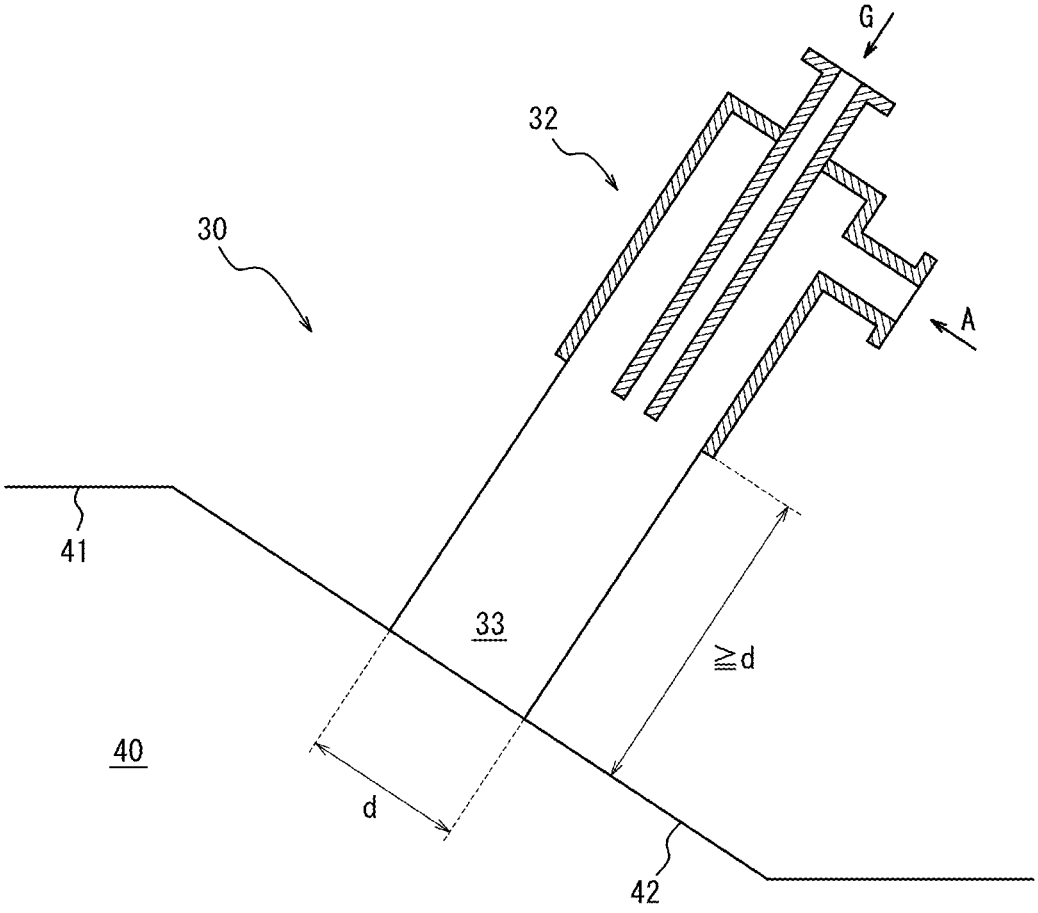
FIG. 4 is a schematic diagram illustrating the structure of a sub burner part in another embodiment.

FIG. 4 is a schematic diagram illustrating the structure of the sub burner part in another embodiment. In this embodiment, the sub burner part 30 has a sub burner nozzle 32 with a diameter d. The end of the sub burner nozzle 32 is provided further inward by a distance of d or more than a surface of the tapered part 42. The fuel gas discharged from the sub burner nozzle 32 is ignited in a space 33 to form flame (sub burner flame) so that the flame may extend outward beyond a surface of the tapered part 42. The end of the sub burner nozzle 32 is thus provided at an inner position of the burner body 10, thereby preventing the aforementioned effect of an accompanied flow to enable sub burner flame to be stably held without using a surface combustion burner. When the sub burner part 30 has, as the sub burner nozzle 32, a slit nozzle with a width d in the short-side direction, the end of the sub burner nozzle 32 is also preferably provided further inward by a distance of d or more than a surface of the tapered part 42. To curb the effect of an accompanied flow, the end of the sub burner nozzle 32 is more preferably provided further inward by a distance of 2 d or more than a surface of the tapered part 42. On the other hand, when the end of the sub burner nozzle 32 is provided further inward by a distance of 15 d or more than a surface of the tapered part 42, flame temperature may be lowered. Therefore, the end of the sub burner nozzle 32 is more preferably provided further inward by a distance of 15 d or less, more preferably 4 d or less than a surface of the tapered part 42.

[Discharge Speed]

As described above, the burner can stably hold flame without flame off even when a discharge speed is high.

Figure 10:
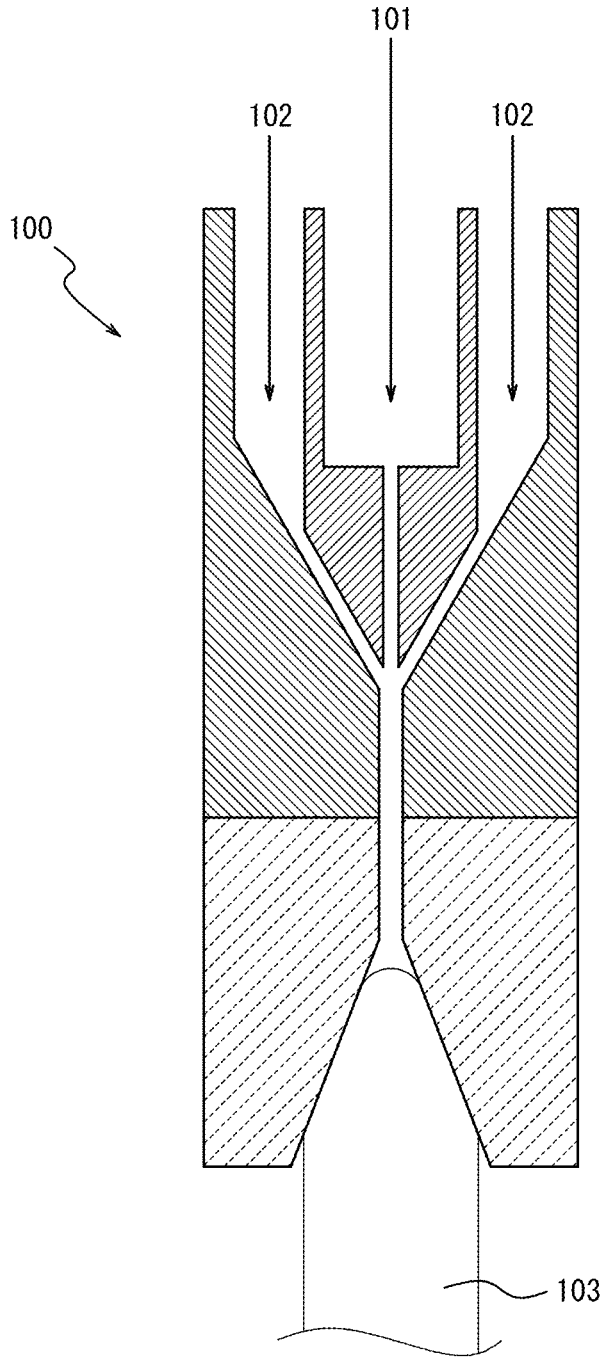
FIG. 10 is a schematic diagram illustrating an example of a premixing combustion burner which is used in a conventional ignition furnace.

The discharge speed, which is a gas flow speed in the straight tube parts of the fuel gas nozzle and the air nozzle of the main burner part, is determined as follows: a discharge speed=a gas flow rate per unit time in a single nozzle/a cross-sectional area of the nozzle. For a nozzle without a straight tube part, the cross-sectional area of the nozzle is the cross-sectional area of the outlet part of the nozzle. When a burner with many nozzles or openings has a conical cone part in front of the nozzles as illustrated in FIG. 10, the discharge speed of the burner can be determined by dividing the sum of the flow rates of fuel gas and air which are discharged from the burner by the cross-sectional area in the outlet of the cone part.

The discharge speed of fuel gas is preferably roughly equivalent to the discharge speed of air for combustion. Specifically, the ratio of the discharge speed of fuel gas to the discharge speed of air for combustion (discharge speed ratio) is preferably 0.8 to 1.2. In a burner with a conical cone, the discharge speed ratio in the nozzle opening part in front of the cone is preferably 0.8 to 1.2.

[Flow Rate Ratio of Fuel Gas]

The ratio of the flow rate of fuel gas in the main burner part and the flow rate of fuel gas in the sub burner part (hereinafter, also referred to as "flow rate ratio of fuel gas") significantly affects the stability and the heating ability of flame. Therefore, the ignition furnace preferably comprises a flow rate adjuster capable of independently adjusting the flow rate of fuel gas in the main burner part and the flow rate of fuel gas in the sub burner part. Further, the content of air for combustion can be determined by multiplying the flow rate of fuel gas by the theoretical air content of the fuel gas and the air ratio. The ignition furnace preferably comprises a flow rate adjuster capable of independently adjusting the flow rate of air for combustion in the main burner part and the flow rate of air for combustion in the sub burner part. The flow rate adjuster includes a flow adjusting valve.

When the sum of the flow rate of fuel gas in the main burner part and the flow rate of fuel gas of the sub burner part is 100%, and the flow rate of fuel gas in the sub burner part is less than 15%, a flame temperature is significantly lowered by an accompanied flow, which is likely to cause flame off in the main burner. Therefore, the flow rate of fuel gas in the sub burner part is preferably 15% or more. In other words, a ratio of a flow rate of fuel gas in the main burner part and a flow rate of fuel gas in the sub burner part is preferably 85:15 or less. On the other hand, when the flow rate of fuel gas of the sub burner part is too high, flame is stably held but flame of the main burner part becomes small, thus deteriorating heating ability. Therefore, the flow rate of fuel gas in the sub burner part is preferably 30% or less. In other words, a ratio of a flow rate of fuel gas in the main burner part and a flow rate of fuel gas in the sub burner part is preferably 70:30 or more.

(Evaluation of Maximum Discharge Speed)

Next, to examine the ability of the burner, the following three types of burners were used to evaluate the maximum discharge speed which could hold flame without flame off. The specification of each burner is listed in Table 1.

(Burner 1) a conventional typical premixing combustion burner as illustrated in FIG. 10

(Burner 2) a burner illustrated in FIG. 1 of PTL 1

(Burner 3) a burner having a structure illustrated in FIGS. 1 to 3

The burner 1 was a conventional premixing combustion burner having a cross-sectional shape as illustrated in FIG. 10. The burner 1 had a slit-shaped nozzle having a length of 1 m. As used herein, the length of the nozzle was a length in the longitudinal direction of the slit-shaped nozzle, that is, a length of the nozzle in the direction perpendicular to the paper of FIG. 10. Further, the width of the slit-shaped nozzle was 10 mm in the straight part and 100 mm in the end of the cone part. As used herein, the width of the nozzle was a width of the opening of the slit in a cross-section perpendicular to the longitudinal direction of the slit, that is, a length in the horizontal direction on the paper of FIG. 10. Therefore, the total cross-sectional area in the straight part of the slit-shaped nozzle was 100 $cm^2$.

The burner 2 was a line burner having a length of 1 m comprising a plurality of nozzles with a cross-sectional shape illustrated in FIG. 1 of PTL 1. The line burner had 60 sets of the nozzles linearly disposed in the longitudinal direction of the burner. The burner 2 had a main burner part having a fuel gas nozzle, which had a nozzle diameter of 6 mm. Further, the main burner part of the burner 2 had an air nozzle, which had the same nozzle diameter as that of the fuel gas nozzle. The burner of PTL 1 had two fuel gas nozzles, and thus the line burner had 120 fuel gas nozzles in total. Therefore, the total cross-sectional area of the fuel gas nozzles in the main burner part of the burner 2 was 33.8 $cm^2$. When the burner 2 had 50 sets of nozzles, flame was unstable. Therefore, 60 sets of nozzles were disposed to stabilize flame.

The burner 3 was a line burner having a length of 1 m comprising a plurality of nozzles having a cross-sectional shape as illustrated in FIGS. 1 to 3. The line burner had 50 sets of the nozzles linearly disposed in the longitudinal direction of the burner. The burner 3 had a main burner part having a fuel gas nozzle, which had a nozzle diameter of 6 mm. Further, the main burner part of the burner 3 had an air nozzle, which had the same nozzle diameter as that of the fuel gas nozzle. As illustrated in FIG. 2, each burner comprised in the line burner had one fuel gas nozzle, and thus the line burner had 50 fuel gas nozzles in total. Therefore, the total cross-sectional area of the fuel gas nozzles in the main burner part of the burner 3 was 14.1 $cm^2$.

Further, Table 1 also lists the ratio of a flow rate of fuel gas in the main burner part and a flow rate of fuel gas in the sub burner part (flow rate ratio of fuel gas) in each of the burner 2 and the burner 3.

TABLE 1

| | Nozzle width | | | | Total cross-sectional | Flow rate |
|---|---|---|---|---|---|---|
| | Straight part | Cone part | Nozzle diameter (main burner part) | Number of nozzles | area of a discharge part ($cm^2$) | ratio of fuel gas* |
| Burner 1 | 10 mm | 100 mm | (Slit-shaped nozzle with a length of 1 m) | | 100 (Straight part) | — |
| Burner 2 | — | — | 6 mm | 120 | 33.8 (Main burner part) | 75:25 |
| Burner 3 | — | — | 6 mm | 50 | 14.1 (Main burner part) | 75:25 |

*a ratio of a flow rate of fuel gas in a main burner part and a flow rate of fuel gas in a sub burner part The evaluation was performed in a combustion furnace for experiments with a combustion space of 1.4 m×1.4 m×0.4 m. The flow rate of fuel gas and the flow rate of air for combustion were increased while the ratio of the flow rates of the fuel gas and the air for combustion was kept constant, and the maximum discharge speed at which flame could be held without flame blowoff was measured.

As the fuel gas, M gas (mixed gas of coke oven gas and blast furnace gas), which was a by-product in steelworks, was used. The main components of the M gas were $H_2$: 26.5%, CO: 17.6%, $CH_4$: 9.1%, and $N_2$: 30.9%.

Figure 5:
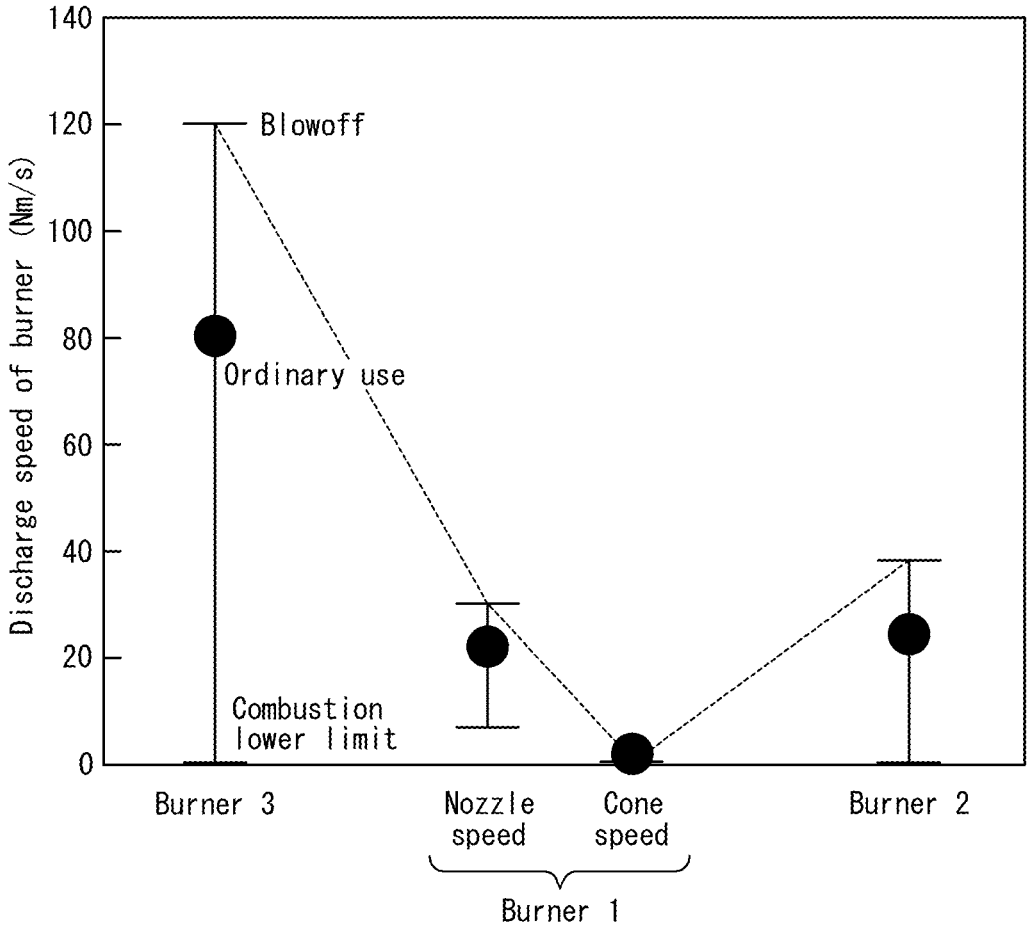
FIG. 5 illustrates a discharge speed in the burners in one of our examples and comparative examples.

The measurement results are illustrated in FIG. 5. In the burner 1, when the flow speed in the straight part of the nozzle was more than 30 m/s, flame was not held and blowoff was caused. The flow speed in the straight tube corresponds to 3 m/s in terms of a flow speed in the end of the cone part. In the burner 2, when the flow speed in the straight tube part of the nozzle was more than 40 m/s, flame was not held and blowoff was caused. On the other hand, the burner 3 had stable flame even when the flow speed in the nozzle part was more than 40 m/s, had unstable flame when the flow speed in the nozzle part was more than 100 m/s, and had blowoff when the flow speed in the nozzle part was 120 m/s.

From the above results, it is found that our burner can achieve stable combustion at an extremely higher discharge speed than that of conventional burners. When our heating device is actually used in industries at almost the maximum flow speed which would cause no blowoff, the blowoff risk may be enhanced by fluctuations in the operation of a supply system. Therefore, the burner is preferably used at a flow speed less than the maximum flow speed which would cause no blowoff. FIG. 5 illustrates an example of a flow speed in an actual ordinary use.

EXAMPLES

Example 1

Using, as a burner for an ignition furnace, the burner which can hold flame under the condition that the flow speed of fuel gas is high, and a conventional burner, the effect of the flow speed of fuel gas on quality of sintered ore was evaluated.

Using a downward suction-type Dwight Lloyd sintering machine having a palette width of 4 m and an effective area of 295 $m^2$, sintered ore was manufactured from raw material with the same grade (using iron ore of one brand, mix proportion of quicklime: 2.3%, water: 7.5%, the thickness of a raw material charged layer: 580 mm). The manufactured sintered ore was cooled by a cooler, and then separated using a sieve with a mesh size of 75 mm into lumps of sintered ore having a size of more than 75 mm and sintered ore having a size of 75 mm or less. The lumps were crushed and subsequently mixed with the sintered ore having a size of 75 mm or less. The mixed sintered ore was separated using a sieve with a mesh size of 5 mm into sintered ore products having a size of more than 5 mm and generated powder having a size of 5 mm or less. Then, the "powder generating rate" was evaluated which is defined as a mass ratio (%) of the generated powder with a size of 5 mm or less to the total production of sintered ore (total mass of the products with a size of more than 5 mm and the generated powder with a size of 5 mm or less).

An ignition furnace had a line burner having burners linearly disposed in a palette width direction or had a slit burner disposed so as to cover the whole palette width. The burner had a discharge opening of fuel gas disposed 0.4 m above a raw material charged layer. The burner 1 was a conventional typical premixing combustion burner (slit burner) as illustrated in FIG. 10, the burner 2 was a burner (line burner) as illustrated in FIG. 1 of PTL 1, and the burner 3 was a burner (line burner) having a structure illustrated FIGS. 1 to 3. Table 2 lists the nozzle diameter of a fuel gas nozzle, the number of fuel gas nozzles disposed per meter in length of the line burner, and the fuel gas flow speed in test. The burner 2 and the burner 3 used a planar combustion burner as a sub burner. The ratio of a flow rate of fuel gas in the main burner part: a flow rate of fuel gas in the sub burner part was 75:25. In Test No. 1 to 4, 7, and 8, the fuel gas flow rate was approximately equalized by adjusting the diameter of the nozzle and the number of the nozzles. In Test No. 5 and 6, the gas flow speed was reduced by making the gas flow rate lower than the condition of Test 7.

Figure 6:
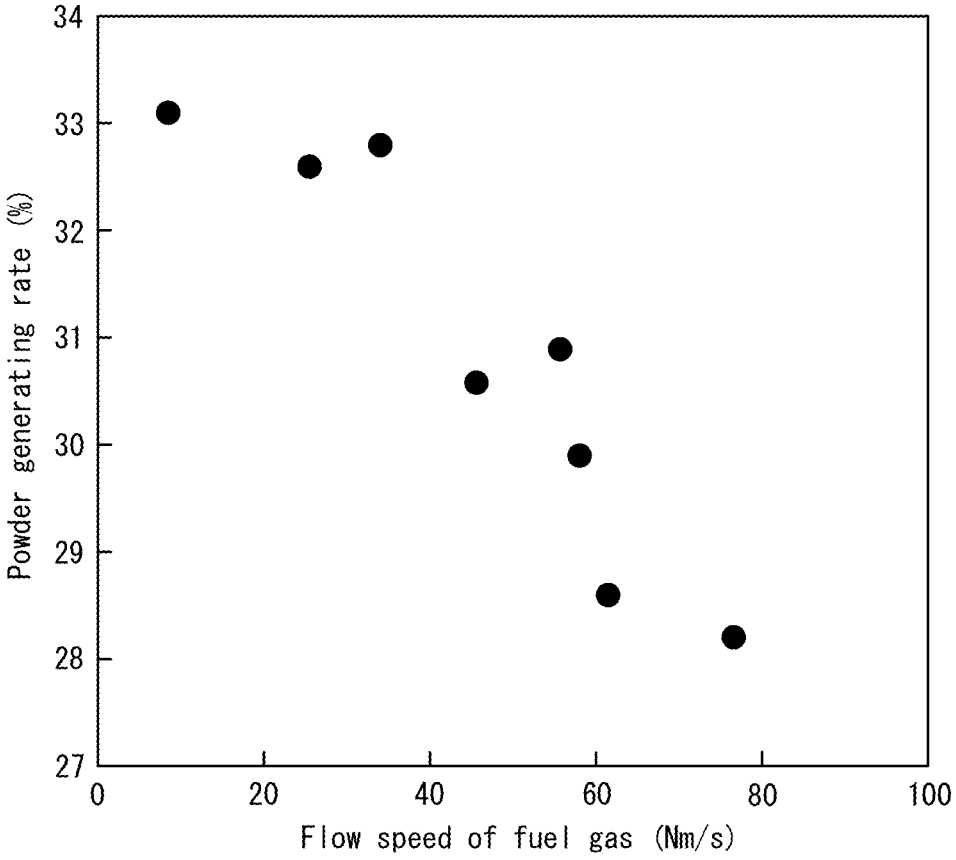
FIG. 6 illustrates flow speed of fuel gas in an ignition furnace and a powder rate of sintered ore.

The measurement results are listed in Table 2 and illustrated in FIG. 6. As the flow speed of fuel gas was increased, the powder generating rate tended to be decreased. In particular, when the flow speed of fuel gas was 40 m/s or more, the powder generating rate was significantly decreased. From the result, it is found that by setting the flow speed of fuel gas to 40 m/s or more, sintered ore having high strength and a high lump yield rate (sintered ore having reduced generation of powder) can be manufactured.

TABLE 2

| No. | Burner type | Nozzle diameter (mm) | Number of nozzles (number/m) | Flow speed (Nm/s) | Powder generating rate (%) | Remarks |
|---|---|---|---|---|---|---|
| 1 | Burner 1 | Slit-shaped with a nozzle width of 10 mm | | 8.6 | 33.1 | Comparative Example |
| 2 | Burner 2 | 6 | 120 | 25.6 | 32.6 | Comparative Example |
| 3 | Burner 3 | 9 | 40 | 34.1 | 32.8 | Comparative Example |
| 4 | Burner 3 | 9 | 30 | 45.5 | 30.6 | Example |
| 5 | Burner 3 | 6 | 50 | 55.6 | 30.9 | Example |
| 6 | Burner 3 | 6 | 50 | 57.9 | 29.9 | Example |
| 7 | Burner 3 | 6 | 50 | 61.3 | 28.6 | Example |
| 8 | Burner 3 | 6 | 40 | 76.5 | 28.2 | Example |

Figure 7:
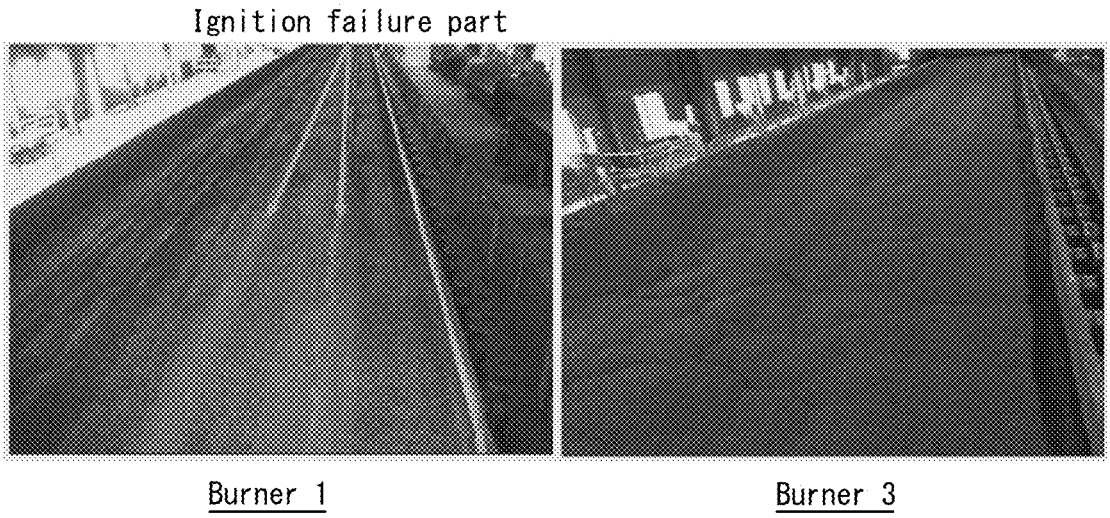
FIG. 7 is a photograph illustrating a state of a surface of a raw material layer after ignition in an ignition furnace.

FIG. 7 is photographs which present the state of a surface of a raw material layer after ignition when the burner 1 was used and the flow speed of fuel gas was 8.6 m/s and when the burner 3 was used and the flow speed of fuel gas was 61.3 m/s. From the photographs, it is found that for the burner 1, the raw material layer had an ignition failure part extending in the feeding direction in a strip shape, while for the burner 3, the raw material layer was uniformly ignited.

Example 2

Next, to investigate a reason that a high flow speed of fuel gas enables uniform ignition of a raw material layer and thus increase the strength of sintered ore, the inventors examined the heating power of a burner and temperature distribution.

Figure 8:
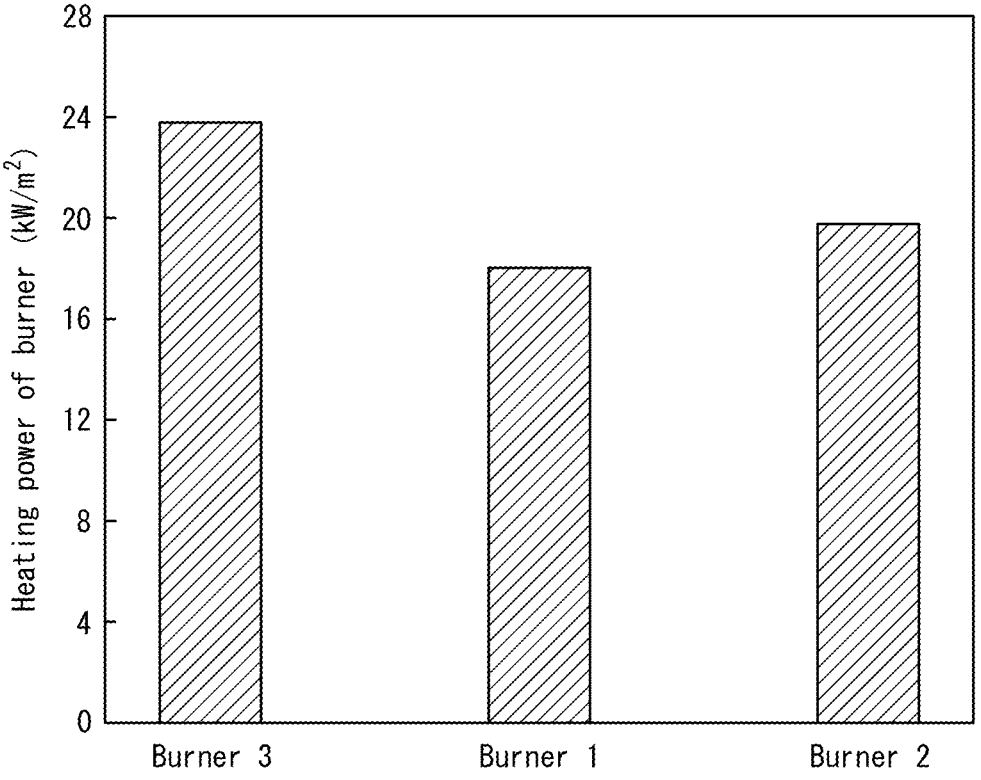
FIG. 8 illustrates heating power in burners.

Using the same measurement device as that in the measurement of FIG. 5, water-cooled chillers which simulated an object to be heated were disposed 0.4 m away from the burners so as to face the burners, and the heating power of the burners was evaluated on the basis of the temperature rise of the water. FIG. 8 illustrates the heating power of the burners which had the same flow rate of fuel gas and the same air ratio. At that time, the flow speed is a flow speed in the nozzle part of 10 m/s in the burner 1, and 70 m/s in the burner 3. It is found that in the burner 3, the heating power was extremely increased, compared with the burner 1 and the burner 2.

Figure 9:
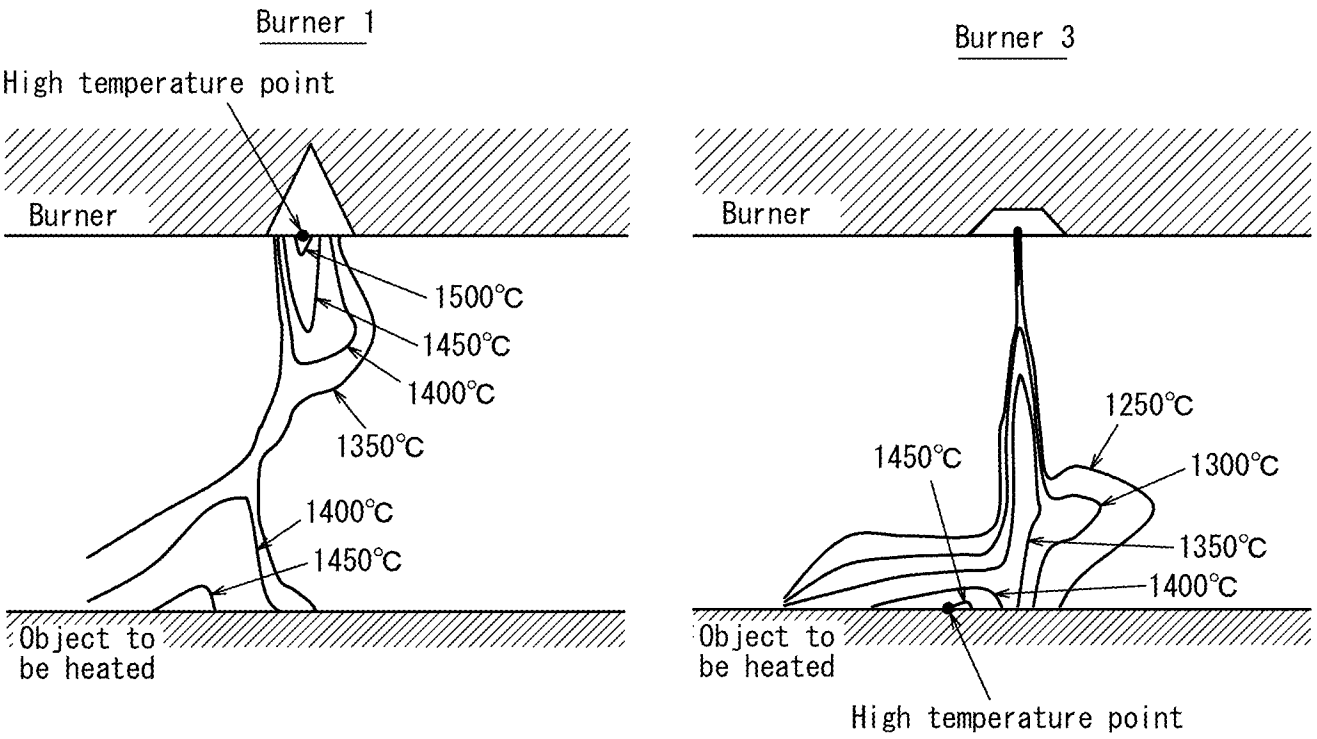
FIG. 9 illustrates a measurement example of temperature distribution in a burner 1 and a burner 3.

Further, during the measurement, the distribution of flame temperature in the burner 1 and the burner 3 was measured using a thermocouple, and according to the measurement, isotherms were created in a cross-sectional direction of the burners. FIG. 9 illustrates the results. The burner 1 and the burner 3 were measured with the same flow rate of fuel gas and the same air ratio. The burner 1 had combustion in the inside of the cone in front of the burner, and much of the fuel gas finished combustion before reaching the object to be heated. On the other hand, in the burner 3, the fuel gas discharged from the main burner was ignited by flame of the sub burner and started to combust near the middle part between the burner and an object to be heated, and much of the fuel gas was combusted in the vicinity of the object to be heated. In the burner of the burner 3, as compared with the burner of the burner 1, the high temperature region was generated intensively in the vicinity of the surface to be heated. It is conceivable that as the gas flow speed was increased, a large quantity of heat was transferred to the surface to be heated and the high temperature region was generated intensively in the vicinity of the surface to be heated as illustrated in FIG. 8, thus decreasing uneven ignition to improve the strength of sintered ore and the lump yield rate.

REFERENCE SIGNS LIST

1 burner
10 burner body
20 main burner part
21 fuel gas nozzle
22 air nozzle
23 pressure equalizing chamber
30 sub burner part
31 porous plate
33 space
40 recessed part
41 bottom part
42 tapered part
50 sub burner flame
60 flame
100 premixing combustion burner
101 fuel gas
102 air
103 flame

The invention claimed is:

1. A method for manufacturing sintered ore comprising:

charging sintering raw material comprising fine ore and carbon material on a circulatively moving pallet to form a raw material layer;

igniting the carbon material on a surface of the raw material layer and sucking air from above the raw material layer down to below the palette so that the air is introduced into the raw material layer; and combusting the carbon material in the raw material layer to thereby manufacture sintered ore, wherein fuel gas is discharged from a nozzle at a flow speed of 40 m/s or more, the discharged fuel gas is combusted to generate combustion gas, and the combustion gas hits against a surface of the raw material layer for igniting the carbon material.

2. The method for manufacturing sintered ore according to claim 1, wherein the combustion gas is generated using a burner comprising:

a main burner part having a fuel gas nozzle configured to discharge the fuel gas and an air nozzle configured to discharge air for combustion; and a sub burner part positioned further outward than the main burner part and configured to combust the fuel gas discharged from the main burner part.

3. The method for manufacturing sintered ore according to claim 2, wherein the burner has an end towards which a flame is formed;

the end has a recessed part; and the recessed part has a bottom part and a tapered part wherein the tapered part gradually widens from the bottom part towards the end of the burner.

4. The method for manufacturing sintered ore according to claim 3, wherein the bottom part and the tapered part, which form the recessed part, make an angle θ of 20° or more.

5. The method for manufacturing sintered ore according to claim 1, wherein the flow speed of the fuel gas is 50 m/s or more and 150 m/s or less.

6. The method for manufacturing sintered ore according to claim 2, wherein the flow speed of the fuel gas is 50 m/s or more and 150 m/s or less.

7. The method for manufacturing sintered ore according to claim 3, wherein the flow speed of the fuel gas is 50 m/s or more and 150 m/s or less.

8. The method for manufacturing sintered ore according to claim 4, wherein the flow speed of the fuel gas is 50 m/s or more and 150 m/s or less.

* * * * *